US009368297B2

(12) United States Patent
Raupach et al.

(10) Patent No.: US 9,368,297 B2
(45) Date of Patent: Jun. 14, 2016

(54) ILLUMINATED, WATER- AND DUST-PROOF SWITCHING ELEMENT

(71) Applicants: EAO Automotive GmbH & Co. KG, Auerbach (DE); EAO AG, Olten (CH)

(72) Inventors: Danny Raupach, Auerbach (DE); Karl-Heinz Krieg, Auerbach (DE)

(73) Assignees: EAO Automotive GmbH & Co. KG, Auerbach (DE); EAO AG, Olten (CH)

( * ) Notice: Subject to any disclaimer, the term of this patent is extended or adjusted under 35 U.S.C. 154(b) by 2 days.

(21) Appl. No.: 14/357,716

(22) PCT Filed: Oct. 11, 2012

(86) PCT No.: PCT/DE2012/000991

§ 371 (c)(1),
(2) Date: May 12, 2014

(87) PCT Pub. No.: WO2013/067984

PCT Pub. Date: May 16, 2013

(65) Prior Publication Data

US 2015/0060245 A1 Mar. 5, 2015

(30) Foreign Application Priority Data

Nov. 10, 2011 (DE) ..... 10 2011 118 178

(51) Int. Cl.

| | |
|---|---|
| ***H01H 13/06*** | (2006.01) |
| ***H01H 9/04*** | (2006.01) |
| ***H01H 13/02*** | (2006.01) |
| ***H01H 13/10*** | (2006.01) |

(52) U.S. Cl.

CPC ..... *H01H 13/06* (2013.01); *H01H 9/047* (2013.01); *H01H 13/023* (2013.01); *H01H 13/10* (2013.01); *H01H 2009/048* (2013.01); *H01H 2013/026* (2013.01); *H01H 2213/006* (2013.01); *H01H 2219/048* (2013.01); *H01H 2221/03* (2013.01); *H01H 2223/002* (2013.01); *H01H 2223/006* (2013.01); *H01H 2223/044* (2013.01); *H01H 2229/046* (2013.01); *H01H 2239/034* (2013.01)

(58) Field of Classification Search

CPC ..... H01H 13/06; H01H 1/00; H01H 3/00; H01H 3/02; H01H 3/12; H01H 5/00; H01H 5/04; H01H 9/02; H01H 9/04; H01H 9/041; H01H 9/045; H01H 9/047; H01H 13/00; H01H 13/04; H01H 13/14; H01H 13/26; H01H 13/50; H01H 2003/12; H01H 2013/00; H01H 2013/04; H01H 2013/50; H01H 2223/00; H01H 2223/002; H01H 2223/006; H01H 2300/008; H01H 2300/006; H01H 2300/01; H01H 2300/012

USPC ..... 200/302.2

See application file for complete search history.

(56) References Cited

U.S. PATENT DOCUMENTS

2012/0061227 A1 3/2012 Chu

FOREIGN PATENT DOCUMENTS

| | | |
|---|---|---|
| DE | 35 19 872 | 12/1986 |
| DE | 86 30 188.8 | 7/1987 |

(Continued)

*Primary Examiner* — Renee Luebke
*Assistant Examiner* — Anthony R. Jimenez
(74) *Attorney, Agent, or Firm* — Norris McLaughlin & Marcus PA

(57) ABSTRACT

An illuminated, waterproof and dust-proof switching element for converting a linear movement of a push button into an electrical switching signal, has a housing and a cap which is axially displaceable within the housing along a stroke path between two end bearings. The cap has a protective membrane for external sealing that is formed from a flexible plastic material by way of multicomponent injection molding. The switching element includes within the housing at least four contacts, a pressure compensation element, a circuit board on which at least one push button and at least two lighting elements are arranged, a silicone pad as a restoring element, a guide, an end stop, a cap with integrally molded protective membrane, and a frame. At least two pairs of the contacts have a like contour including a linear arrangement in the region of a plug and rectangular arrangement in the interior.

16 Claims, 6 Drawing Sheets

(56) References Cited

FOREIGN PATENT DOCUMENTS

| | | |
|---|---|---|
| DE | 3737119 | 5/1989 |
| DE | 10 2008 034 046 | 1/2009 |
| DE | 10 2009 008 537 | 2/2009 |
| DE | 10 2008 015 111 | 6/2009 |
| DE | 10 2009 029 825 | 6/2009 |
| DE | 10 2010 008 809 | 10/2010 |
| DE | 10 2011 000 112 | 8/2011 |
| EP | 1 233 434 | 8/2002 |
| EP | 2 175 462 | 4/2010 |

ILLUMINATED, WATER- AND DUST-PROOF SWITCHING ELEMENT

BACKGROUND OF THE INVENTION

The invention relates to an illuminated, waterproof and dust-proof switching element for converting a linear movement of a push button into an electrical switching signal.

Illuminated, waterproof and dust-proof switching elements are already used in many variants in vehicle construction and are thus generally known.

EP 2 175 462 A1 describes a sealed switch for converting the linear movement of a push button into an electrical switching signal, having a housing by which the push button is supported, said push button being held in the interior of said housing in an axially movable manner, having a baffle which is securely connected to the push button, and having a protective cap which is made of a flexible plastic material and which covers the baffle and seals it off from the outside; the interior of the switch is said to be encapsulated in an airtight and watertight manner and the switching characteristic upon actuation of the push button is said to be configured so as to be as uniform as possible over the entire stroke path. Due to the fact that the protective cap is pretensioned, since the baffle is curved outward in the manner of a dome or hemisphere counter to the direction of movement of the switch, a uniform switching characteristic is produced since, immediately upon actuation of the protective cap, the baffle is already pressed out of its starting position. While the protective cap and the baffle are moved in the direction of the switching contact, no actuating forces of different magnitude have to be applied, since the protective cap is moved between a top and a bottom stretching point so that no additional restoring forces occur as a result of overstretching of the protective cap. Furthermore, a joint-free curved surface of the protective cap is obtained, so that there is nowhere for dirt to accumulate and moreover wiping is easily possible. In addition, due to the pretension that exists, the protective cap has no integral moldings, beads or the like that may serve as a place for dirt particles to accumulate.

An electrical switch is known from DE 10 2008 034 046 A1. The electrical switch is located in a housing provided with an opening. A contact system is located inside the housing, and provided on the housing is an actuating member in the form of a rocker, which protrudes at least partially out of the housing and produces a switching effect on the contact system. A bellows-type seal is attached at one end to the actuating member and at the other end to the housing, such that the seal substantially covers the opening. The actuating member consists of two parts, an inner rocker and an outer rocker, wherein the seal is clamped between the two parts and is thus integrated in the actuating member.

SUMMARY OF THE INVENTION

Proceeding from the prior art, the problem addressed by the invention is that of further developing a switch of the type mentioned above such that it can be used externally, is robust against external influences such as freezing and the like, is provided with a pressure compensation element and, in the assembled state, also has a sealing effect with respect to the attachment element. Furthermore, the switching element in the assembled state should have no visible gap between this and the attachment element, in order to protect against dirt, sand, snow or frost.

An illuminated, waterproof and dust-proof switching element according to the invention for converting a linear movement of a push button into an electrical switching signal has a housing and a cap which is axially displaceable within the housing along a stroke path between two end bearings, said cap being provided with a protective membrane for external sealing that is formed from a flexible plastic material by way of multicomponent injection molding, the switching element preferably serving for external use for switching and/or displaying operating states of electrical assemblies, in the automotive industry.

According to the invention, the above mentioned problem is solved in that the switching element includes within the housing: at least four contacts, at least two of the contacts being designed with an identical contour, and following a rearrangement from a linear arrangement thereof in the region of the plug to a square arrangement in the interior, as a result of which a symmetrical structure is possible inside the switching element; a pressure compensation element which is hot-welded or ultrasonically welded from inside and achieves pressure compensation with respect to the external environment by means of a meandering vent duct; a circuit board on which at least one push button and at least two lighting elements are arranged; a silicone pad which serves as a restoring element and as a light seal; a guide which has at least three guide contours that engage in the guide grooves in the housing; an end stop at which the guide defines, in at least three regions, the end position or rest position of the switching element and also serves as a light shield; a cap with an integrally molded protective membrane which performs the sealing function of the switching element and the sealing with respect to the assembly bezel, and provides the robustness against freezing, as well as providing an overmolded locator light and functional light; and a frame, LEDs are preferably used as the lighting elements.

A significant advantage of this inventive design solution is the compact structure that is possible as a result, and the easy assembly of the switching element to the mating contour.

The switching element is characterized in particular by the simple and compact design thereof and can be used both as an opening switch and as a closing switch. Due to the small and compact design, the weight of the switching element is also minimized.

Further advantageous developments of the invention will become apparent from the exemplary embodiment below.

The invention will be explained in more detail on the basis of an exemplary embodiment. In the figures:

BRIEF DESCRIPTION OF THE DRAWINGS

In the figures:

FIGS. 1 and 2 show a perspective view and an exploded view of the switching element 1.

Figure 1:
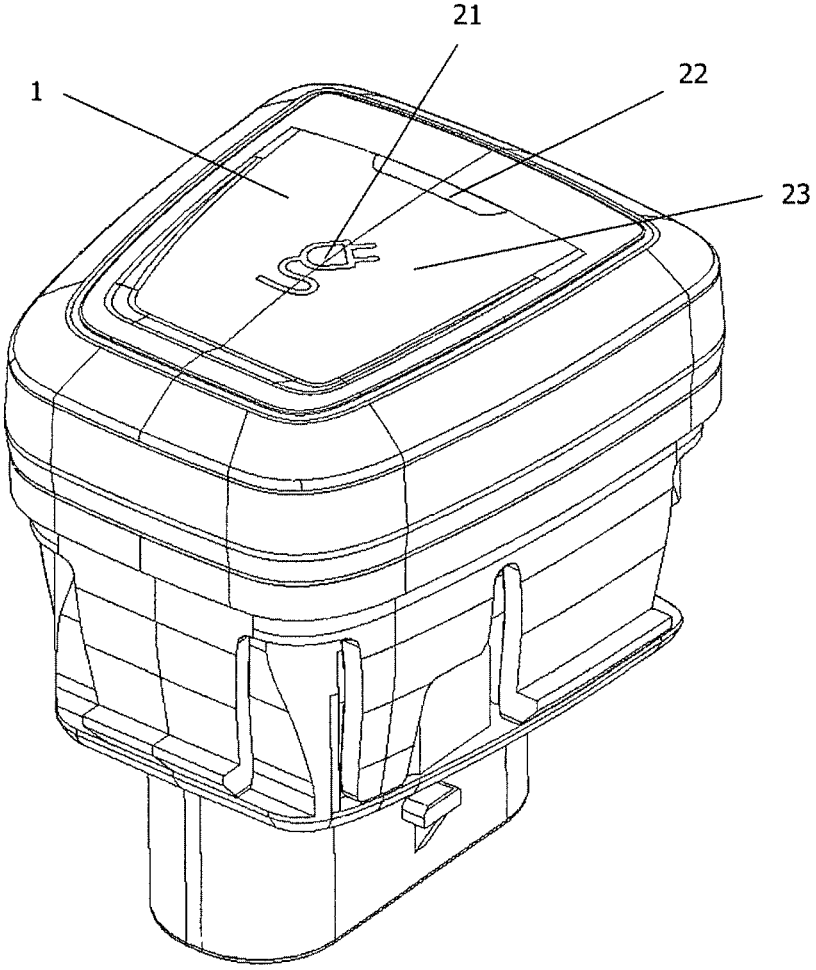
FIG. 1 shows a perspective view of the switching element.
Figure 2:
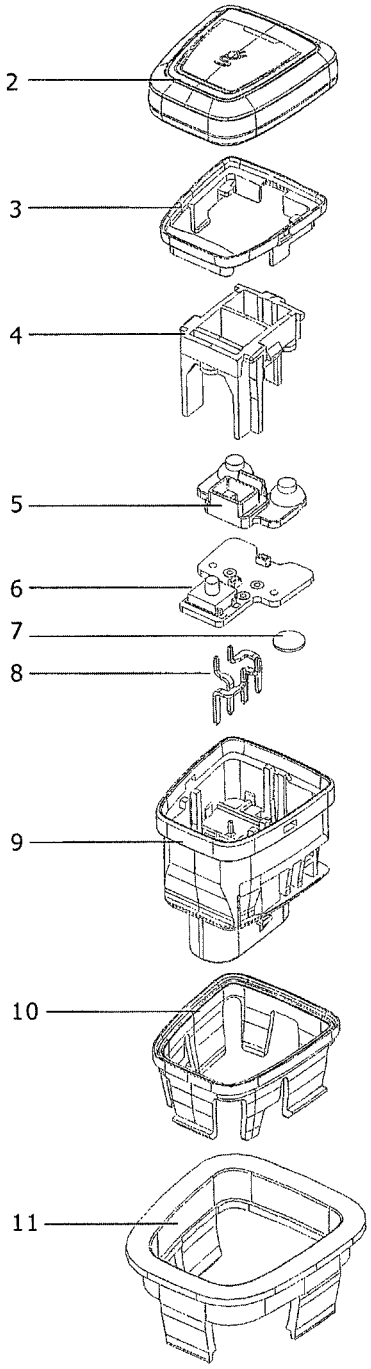
FIG. 2 shows an exploded view of the switching element with the assembly bezel.

In principle, the switching element 1 comprises the components: cap 2, end stop 3, guide 4, silicone pad 5, circuit board 6, pressure compensation element 7, contacts 8, housing 9 and frame 10.

Figure 3:
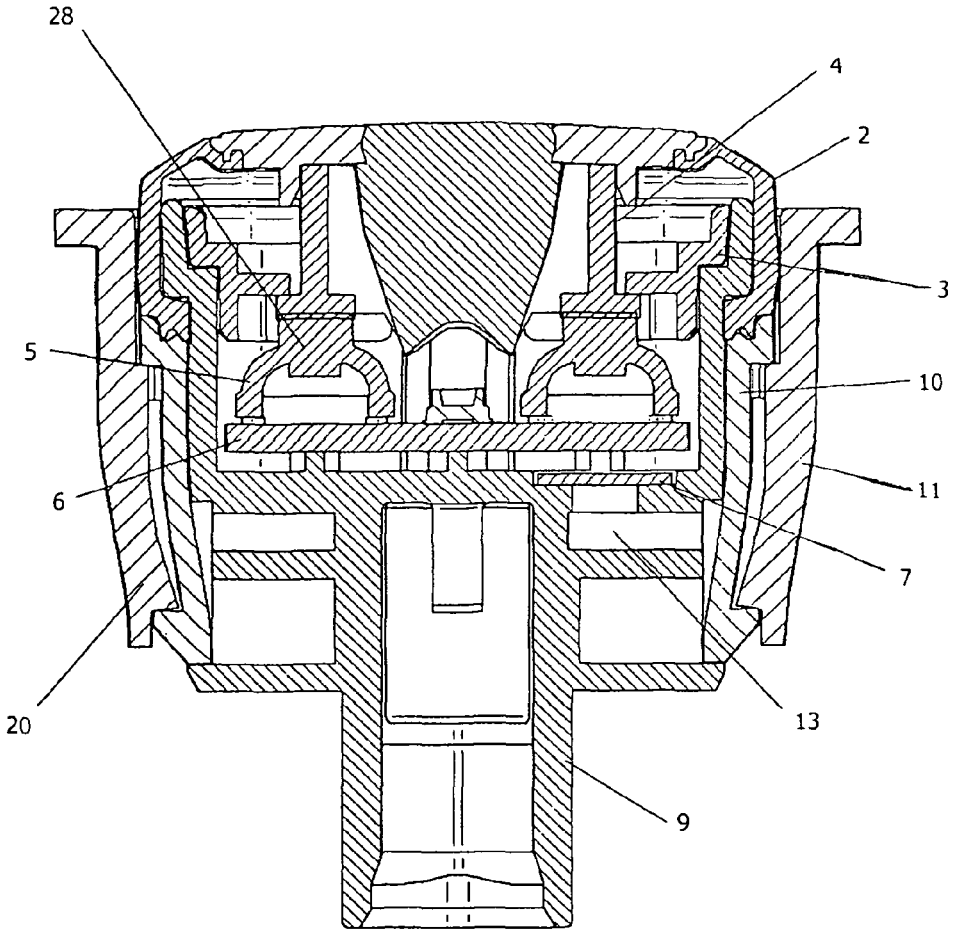
FIG. 3 shows a section through the switching element with the assembly bezel.

In the housing 9, which is preferably produced from an injection-molded plastic part, four contacts 8 are arranged next to one another toward the outside and in a square shape by way of rearrangement in the interior of the housing 9. The square arrangement allows a symmetrical construction inside the switching element 1, wherein the LEDs for the lighting and the push button can be positioned precisely in the center. The contacts 8 are respectively formed in pairs as identical parts. As a result, it is possible to reduce the complexity in terms of tools and handling. Due to the rearrangement in the overmolded region, the contacts 8 form a meandering structure, resulting in mechanical anchoring as protection against plug perforation in the housing 9 and an increase in the creepage distance in the event of water ingress. At the same time, in this region of overmolding, an adhesion promoter may be circumferentially applied to the contacts 8, whereby media-proof overmolding is possible. The contacts 8 are contacted by means of a plug connection, but other known connection techniques which are customary per se in the field can also be used. Accommodated in the inner region of the housing 9 is the pressure compensation element 7 (FIG. 3), which is attached in a media-proof manner by means of hot welding or ultrasonic welding. The pressure compensation between the interior of the switching element 1 and the external ambient conditions can take place via a meandering vent duct 13 in the housing 9, which is open toward the outside. In conjunction with the frame 10, which is mounted over the housing 9 and at the same time forms a protective cover for the vent duct 13, the pressure compensation element 7 is protected against damage caused by external influences. Due to the symmetrical design, there may be attached to the opposite side a second pressure compensation element 7 or alternatively a volume compensation element, for example in the form of a silicone membrane, which, upon actuation of the switching element 1, equalizes the volume to be compressed due to the hermetic seal and thus counteracts the otherwise damping effect of the air compression and thus optimizes the haptic properties.

Figure 4:
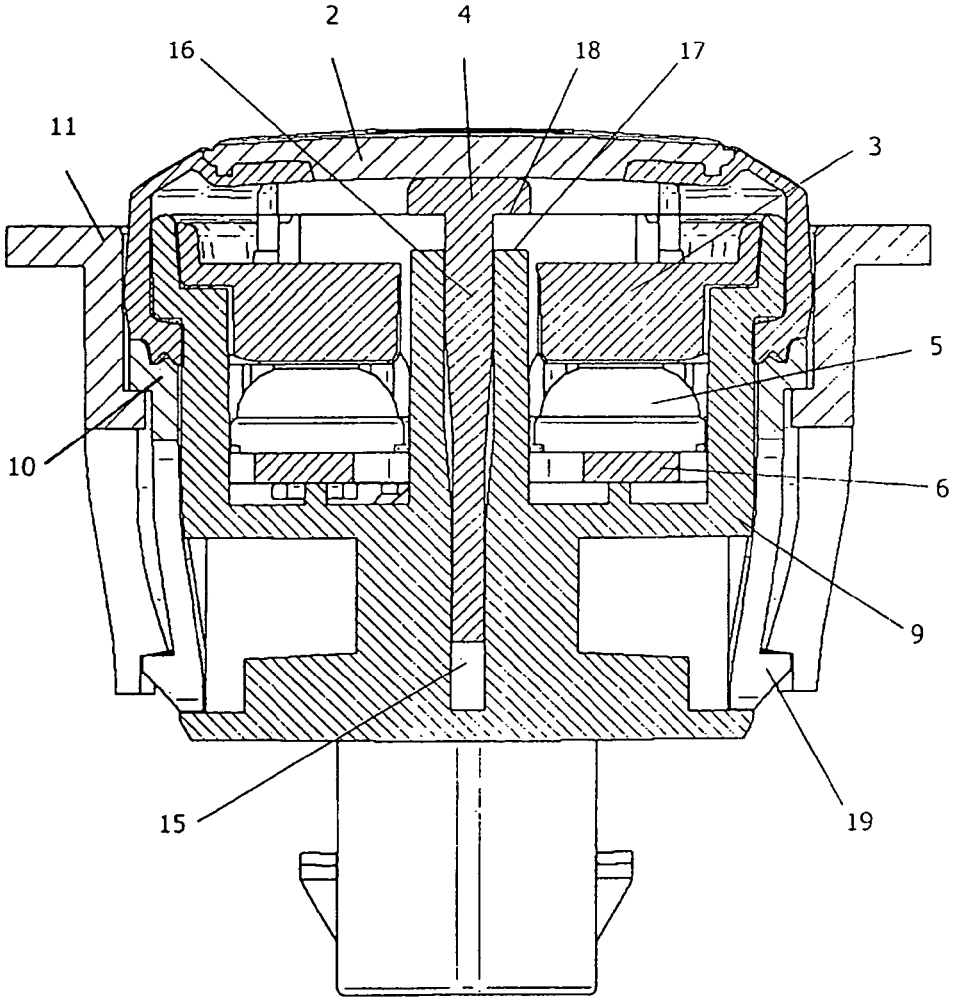
FIG. 4 shows a section through the switching element with the assembly bezel.

The housing 9 is formed in one piece with an integrated plug receptacle 14, which is suitable for receiving a waterproof plug. The housing 9 (FIG. 4) has at least three guide grooves 15, which correspond to the guide contours 16 of the guide 4. In order to achieve a short assembly depth and a compact design with a guide that is as long as possible, the guide grooves 15 in the housing 9 are designed such that the plug receptacle 14 for receiving the waterproof plug protrudes into the interior of the switching element 1 and the guide grooves 15 extend outward past the plug receptacle. Another advantage of this design solution lies in the fact that the area for accommodating the pressure compensation element 7 and the circuit board 6 is located close to the top opening of the housing 9. This results in optimal hot welding or ultrasonic welding of the pressure compensation element 7 and a good connection to the circuit board 6, for example by means of a soldered connection. Alternative connection techniques for attaching the pressure compensation element 7, such as gluing, are also possible.

The guide 4 has at least three solid end stops 18, which are integrally molded in the form of a T-shaped profile above the guide contours 16 and, when the switching element 1 is actuated in the direction of actuation, strike the end stops 17 in the housing 9 and thus define the end position of the switching element 1. These solid end stops of the switching element 1, allow for absorption of misuse forces of at least 250N in the direction of actuation, which is to say, without causing any stress on the switching contacts and without damaging the components of the switching element 1.

The switching element 1 is pressed into the attachment element of the assembly bezel 11 with three latching elements 19 arranged on the outer side of the frame 10. In the process, the assembly end stop takes place by way of a shape-stable contour on the frame 10 and the assembly bezel 11, so as to define the height position of the switching element 1 in the assembled state. The height tolerance compensation takes place by way of a slope on the latching hooks 20 of the assembly bezel 11. The design arrangement of the resilient latching hooks 20 in the assembly bezel 11 allows for compact design of the switching element 1, as space on the switching element 1 would otherwise have to be reserved for the deflection of the resilient latching hooks. The latching connection is advantageously made of plastic, in order to ensure electromagnetic compatibility with adjacent components. The design is thus suitable, for example, for external use in the tank cap of an electric vehicle. When using various switching element variants, a mechanical coding between the frame 10 and the assembly bezel 11 may be provided in order to avoid incorrect assembly in the assembly bezel 11. In order to ensure that the switching element 1 can be removed from the assembly bezel 11, there is integrally molded on the latching hooks 20 a contour at which the latching hooks 20 can be bent, and thus the switching element 1 can be removed from the assembly bezel 11. A further advantage of this design lies in the fact that the directions of assembly and of actuation of the switching element 1 are the same, as a result of which the switching element 1 is always pushed into the end position during actuation, while release from the assembled state is not possible.

Figure 5:
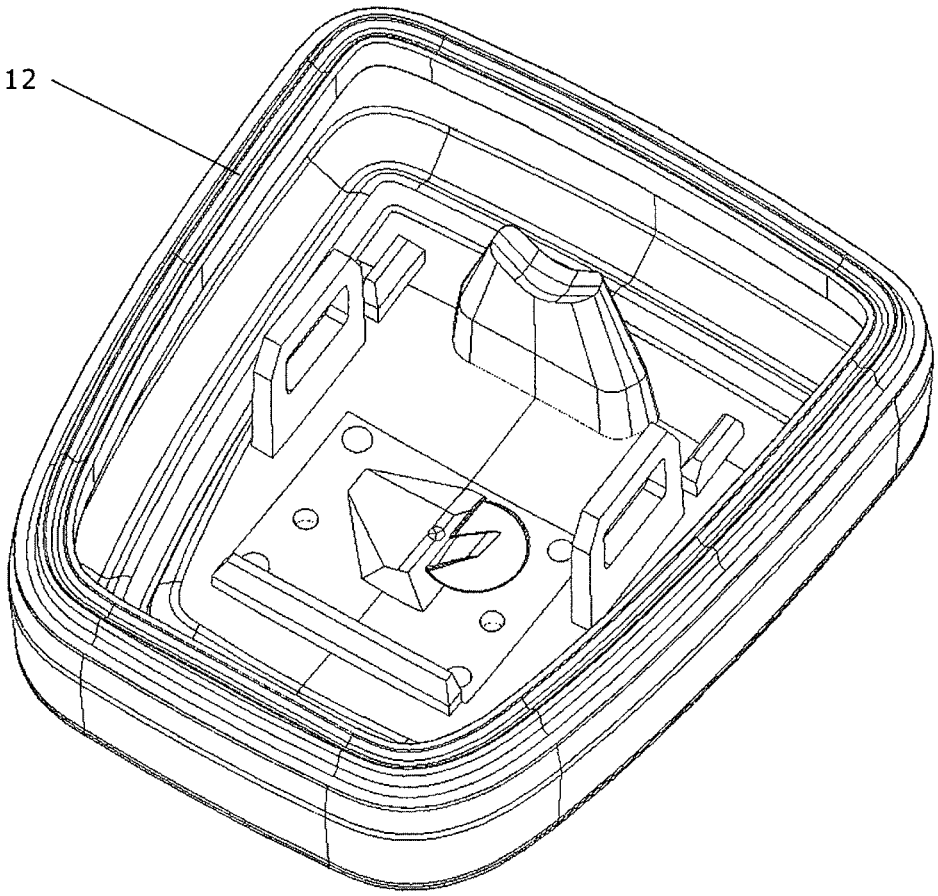
FIG. 5 shows a perspective view of the protective cap.

FIG. 5 shows a perspective view of the cap 2, which is produced by multicomponent injection molding, and serves to seal off the switching element 1 from the ambient conditions and achieve robustness against freezing, allows translational movement of the switching element 1, and provides a locator light 21 and functional light 22. The symbol for the locator light 21 may be embodied in different variants by an interchangeable insert in the injection mold and is preferably made in a white translucent material. The functional light 22 is made in a transparent and volume scattering material, the actuation surface 23 is made in a black non-translucent material and the protective membrane 12 is made in a black flexible plastic material. Alternative materials and colors are possible. By way of example, the protective membrane 12 may be made in a color different to that of the actuation surface 23, in order to indicate the actuation area to the user. In the case of a transparent design of the protective membrane 12, the latter could also be illuminated in order, for example, to indicate the charging state of an electric vehicle.

Figure 6:
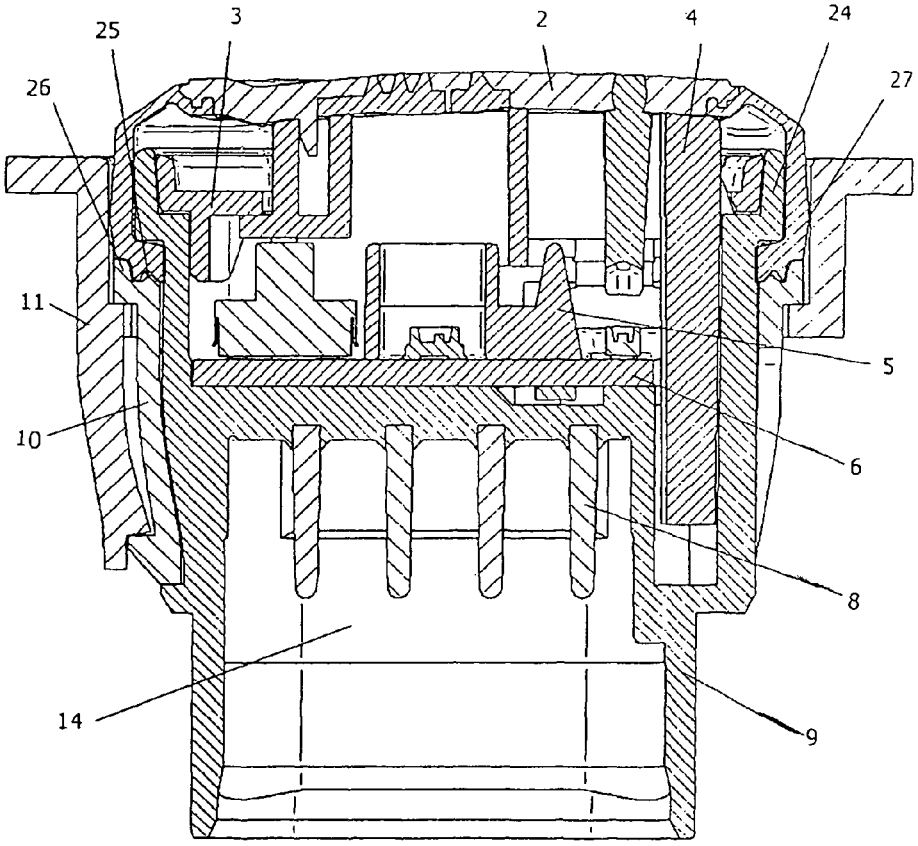
FIG. 6 shows a section through the switching element with the assembly bezel.

All the components are securely connected to one another with a form fit and in a media-tight manner by way of fusing in the injection molding process and by way of mechanical fixings. The cap 2 is assembled to the guide 4 via integrally formed latching elements. The protective membrane 12 is mounted circumferentially with a preload over the edge 24 of the housing 9, so that the protective membrane 12 bears with a form fit against the housing 9. The switching element 1 is sealed, in cooperation with the frame 10, which is mounted over the housing 9 from the plug side. The seal is designed in such a way that a sealing contour 25 is integrally molded circumferentially in the frame 10, which sealing contour presses into the elastic protective membrane 12 and is braced circumferentially with constant pressure against the housing 9. In a manner following this sealing contour 25 (FIG. 6), a circumferentially raised outer edge 26 is integrally molded which, at the time of mounting the frame 10, positions the protective membrane 12 and the sealing contour 25 in cooperation so that a secure assembly is ensured. Furthermore, this provides an option for checking the assembly process. In this case, the frame 10 is clamped between the housing 9 and the protective membrane 12 and thus sits without play in the end position. In this case, the protective membrane 12 is formed such that it has a lateral circumferential sealing contour 27 which, when mounted in the assembly bezel 11, bears laterally and thus seals off the switching element 1 with respect to the assembly bezel 11. Furthermore, the gap to the assembly bezel 11, which is necessary for mounting the switching element 1, is thus reduced and a uniform overall appearance is obtained between the switching element 1 and the assembly bezel 11. As a result, sealing of the switching element 1 itself, as well as sealing with respect to the assembly bezel 11, is ensured with just one seal.

The robustness against freezing of the switching element 1 is achieved in that the protective membrane 12 of the cap 2 is designed uniformly around the circumference and rises from the height position of the assembly bezel 11 toward the starting position of the switching element 1. The height of the rise amounts to at least the actuation travel of the switching element 1.

In the event of icing-up of the switching element 1, the ice is broken up by the actuation of the cap 2, allowing translational movement of the cap 2 for conversion into the electrical switching signal. The restoring movement is also possible due to fact that the ice is broken up at the time of actuation of the switching element 1. Due to the increased actuation surface of the switching element 1, with respect to the height position of the assembly bezel, actuation with gloves is also possible.

The area for accommodating the pressure compensation element 7, the circuit board 6, the silicone pad 5, the guide 4 and the end stop 3 is located entirely inside the housing 9 and the cap 2, in order to ensure that the switching system is protected against dirt and/or fluids.

The silicone pad 5 serves for restoring the switching element 1 and as a light seal between the locator light 21 and the functional light 22. The restoring takes place by at least two restoring domes 28 (FIG. 3) with a linear force/travel characteristic in force equilibrium with the push button. Alternatively, the restoring domes 28 may also be used as additional switching elements, for example to ensure redundancy relative to the push button. Another design possibility is to replace the push button with a silicone switching pad, which in turn can be embodied with a wide range of force/travel characteristics, such as two or three-stage force/travel characteristics. Light shielding takes place by using a non-transparent material with a meandering structure between the locator light 21 and the functional light 22. The end stop 3 is braced between two cutouts in the housing 9, which lie within the sealing region of the switching element 1, and the elastic silicone pad 5, which in turn presses against the circuit board 6. As a result, a play-free and rattle-free design of the switching element 1 in the assembled state is achieved, even under the effects of vibration.

The end stops are arranged such that they are located precisely above the restoring domes of the silicone pad 28 and of the push button. The end stops keep the switching element 1 in a stable rest position, without loading the protective membrane 12 with a compressive stress. The protective membrane is thus in the non-tensioned state, which has a positive effect on the haptic and optical properties and the service life.

The invention claimed is:

1. An illuminated, waterproof and dust-proof switching element for converting linear movement of a push button into an electrical switching signal, comprising:

a housing and a cap which is axially displaceable within the housing along a stroke path between two end bearings;

said cap being provided with an integrally molded protective membrane for external sealing that is formed from a flexible plastic material by way of multicomponent injection molding;

a frame mounted on the housing; and within the housing at least four contacts and a connection for contacting said contacts, the four contacts being comprised of at least two pairs of the contacts, the at least two pairs of contacts being of like contour and, together, forming a linear arrangement in a region of the connection for contacting said contacts and a rectangular arrangement in an interior of the housing; and the switching element further comprising a pressure compensation element, a circuit board on which at least one push button and at least two lighting elements are arranged, a silicone pad as a restoring element and light seal, a guide, and an end stop; and wherein the pressure compensation element communicates with an ambient external environment to the switching element via a vent duct for compensating pressure between an interior of the switching element and the external ambient environment;

wherein the housing is configured to have a meandering channel that forms said vent duct, the vent duct having one end that opens to an interior of the housing within which the circuit board, silicone pad, and guide are situated;

wherein said one end is covered by the pressure compensation element;

wherein a seat is formed by the housing at said one end into which the pressure compensation element seats;

wherein the vent duct has an opposite end that opens at a sidewall of the housing to an external environment of the housing, said opposite end being covered by a latching hook of the frame; and wherein the pressure compensation element does not move with the guide and is located underneath the circuit board.

2. The switching element according to claim 1, wherein the frame forms an exterior protective cover for the vent duct.

3. The switching element according to claim 1, wherein the housing is formed in one piece with an integrated plug receptacle.

4. The switching element according to claim 1, further comprising a guide and, in an interior of the housing at least three guide grooves having contours which correspond to contours of the guide.

5. The switching element according to claim 4, wherein the connection for contacting said contacts comprises a plug receptacle and the guide contours extend into the housing past the plug receptacle.

6. The switching element according to claim 1, wherein the pressure compensation element and the circuit board are accommodated in an area located close to a top opening of the housing.

7. The switching element according to claim 4, wherein the guide has at least three end stops which are arranged in the form of a T-shaped profile above the guide contours.

8. The switching element according to claim 1, further comprising an assembly bezel having latching hooks and wherein a contour which allows easy removal of the switching element without using additional tools is integrally molded on the latching hooks of the assembly bezel.

9. The switching element according to claim 8, further comprising an assembly end stop comprising a shape-stable contour formed on the frame and the assembly bezel.

10. The switching element according to claim 1, wherein the cap comprises a translucent locator light and functional light.

11. The switching element according to claim 4, wherein the cap is connected to the guide with a form fit by way of integrally molded latching elements.

12. The switching element according to claim 1, wherein the protective membrane of the cap is braced and sealed circumferentially with a constant pressure between a sealing contour on the frame and the housing.

13. The switching element according to claim 12, wherein an outer edge which follows the sealing contour is integrally molded on the frame.

14. The switching element according to claim 1, wherein the protective membrane of the cap has a sealing contour laterally around the circumference.

15. The switching element according to claim 8, wherein the protective membrane is so configured and arranged that both sealing of the switching element itself as well as sealing with respect to the assembly bezel is achieved with just the one protective membrane.

16. The switching element according to claim 15, wherein the protective membrane is uniform around its circumference and rises from a height position of the assembly bezel toward a starting position of the switching element.

* * * * *